US012637871B2

(12) United States Patent
Baldwin et al.

(10) Patent No.: US 12,637,871 B2
(45) Date of Patent: May 26, 2026

(54) SWIMMING POOL WINTERIZATION SYSTEM AND METHOD

(71) Applicant: Pentair Water Pool and Spa, Inc., Cary, NC (US)

(72) Inventors: Travis Baldwin, Raleigh, NC (US); Mauricio Valencia, New Hill, NC (US); David Vaughn, Pittsboro, NC (US); Joshua Lutter, Holly Springs, NC (US); Anas Alhajeh, Clayton, NC (US); William Evans, Apex, NC (US); James Miller, Sanford, NC (US); Mitchell Bellamy, Sanford, NC (US)

(73) Assignee: Pentair Water Pool and Spa, Inc., Cary, NC (US)

( * ) Notice: Subject to any disclaimer, the term of this patent is extended or adjusted under 35 U.S.C. 154(b) by 109 days.

(21) Appl. No.: 18/394,976

(22) Filed: Dec. 22, 2023

(65) Prior Publication Data

US 2024/0209648 A1 Jun. 27, 2024

Related U.S. Application Data

(60) Provisional application No. 63/435,234, filed on Dec. 24, 2022.

(51) Int. Cl.
*E04H 4/12* (2006.01)

(52) U.S. Cl.
CPC ..... *E04H 4/129* (2013.01)

(58) Field of Classification Search
CPC ..... A61H 2033/002; A61H 2033/0025; A61H 2033/008; A61H 33/02; A61H 33/028; E04H 4/12–129; E03B 7/006; E03B 7/10–12
See application file for complete search history.

(56) References Cited

U.S. PATENT DOCUMENTS 3,902,202 A * 9/1975 Strange, Jr. ..... E04H 4/12 417/32
5,259,076 A * 11/1993 Voight ..... E04H 4/12 4/496
5,577,274 A * 11/1996 Plotsky ..... E04H 4/12 4/496
6,279,177 B1 * 8/2001 Gloodt ..... A61H 33/60 4/541.3
6,505,357 B2 * 1/2003 Whatmore ..... E04H 4/1209 4/496

(Continued)

FOREIGN PATENT DOCUMENTS

CN 112824612 * 5/2021 ..... E03B 7/10

*Primary Examiner* — David P Angwin
*Assistant Examiner* — Nicholas A Ros
(74) *Attorney, Agent, or Firm* — Husch Blackwell LLP

(57) ABSTRACT

A system and a method for performing an automated winterization process for a swimming pool or spa are provided. A temperature sensor collects a sensed temperature value, which is transmitted and processed by a control system of a connected aquatic system. Based on the sensed temperature value, the swimming pool or spa control system executes the automated winterization process for the swimming pool or spa. The automated winterization process includes displacing water with air using an air-moving device in a first loop path and a second loop path using one or more actuated automatic valves.

20 Claims, 3 Drawing Sheets

FIG. 1

(56) References Cited

U.S. PATENT DOCUMENTS

| | | | | |
|---|---|---|---|---|
| 7,370,668 | B2 * | 5/2008 | Vasilev | F16K 15/02 137/533.19 |
| 9,775,772 | B2 * | 10/2017 | Tempas | A61H 33/6026 |
| 11,720,085 | B2 * | 8/2023 | Roy | G01K 3/005 700/275 |
| 2006/0168611 | A1 * | 7/2006 | Fima | F24H 15/212 141/192 |

* cited by examiner

SWIMMING POOL WINTERIZATION SYSTEM AND METHOD

CROSS-REFERENCE TO RELATED APPLICATIONS

This application claims priority to U.S. Provisional Application No. 63/435,234 filed on Dec. 24, 2022, the entire disclosure of which is incorporated herein by reference.

TECHNICAL FIELD

The present disclosure relates to the winterization of a connected aquatic system like a swimming pool or a spa. More particularly, the embodiments of the present disclosure relate to a method and a system for performing a winterization process for pool and spa equipment using an automated winterization system.

BACKGROUND

Swimming pools are commonly used by people during warm weather months to relax and combat the heat. During colder months, swimming pools are often decommissioned and non-operational. To "winterize" a swimming pool, water is typically completely drained from the swimming pool and the entire fluid circuit of the aquatic system to prevent frozen lines from freezing temperatures. Proper winterization can be important to avoid corrosion, breakage, or malfunctioning of various components or aspects of the aquatic system.

Draining the water from the swimming pool or spa is currently performed manually by pool owners or by a technician. To start the winterization process, the pool owners select a day and a time based on a personal determination of the appropriate time to winterize the aquatic system. Further, winterization of the aquatic system involves manually connecting an air-moving device (for displacing water with air) on an ad-hoc basis to the components of the system (such as skimmer, pump, heater, filter, return valves, etc.). The air-moving device is manually operated by a user to drain the water. Typically, a user will operate a vacuum system to manually remove the water from the pool or spa through a skimmer. Once the water is drained, the air-moving device is manually removed from the system. The process of manually winterizing a pool is time-consuming and involves significant manual effort.

Therefore, the art recognizes the need for a winterization system and method to automatically drain water from the aquatic system without manual effort by the user. Existing technologies also lack the ability to intelligently determine the appropriate time to start winterization of the aquatic system.

SUMMARY

In one aspect of the present disclosure, a method for performing an automated winterization process for a swimming pool or spa is provided. The method includes collecting a sensed temperature value using a temperature sensor The sensed temperature value is transmitted to a control system of a connected aquatic system. A process of the control system can compare the sensed temperature value to a pre-defined threshold value. The processor can execute the steps of the automated winterization process when the sensed temperature value is at or below the pre-defined threshold value. The method further includes an air-moving device that can displace water with air in a first loop path and a second loop path of the connected aquatic system.

In some aspects, the air-moving device is positioned between a pump and a skimmer of the connected aquatic system. In some forms, the air-moving device is provided in a form of an air blower, an accumulator, or an air compressor. In some embodiments, the control system executes the automated winterization process for the swimming pool or spa when an advanced learning model generates a recommendation based on weather patterns. The control system may also recommend a time for executing the automated winterization process using an advanced learning model trained on historical data of temperature values. In some embodiments, the method further includes generating and transmitting an initiation message to a mobile device of a user associated with the swimming pool or spa, wherein the initiation message includes a recommendation for executing the automated winterization process. The method can also include executing the automated winterization process after a confirmation message is received from the mobile device of the user associated with the swimming pool or spa. In some forms, in the first loop path, the automated winterization process is executed from a skimmer to the swimming pool or spa. In some aspects, in the second loop path, the automated winterization process is executed from a pump to the swimming pool or spa. In some forms, the first loop path, the skimmer is directly connected to the swimming pool or spa. In some embodiments, in the second loop path, the pump is connected to a filter and the filter is connected to a heater. In this example, the heater can be connected to a sanitizer, which is connected to one or more pool returns. The one or more pool returns can be connected to the swimming pool or spa.

In another aspect, a method for performing an automated winterization process for a connected system including a swimming pool or spa is provided. The method can include collecting a sensed temperature value using a temperature sensor. A processor of the control system can compare the sensed temperature value to a pre-defined threshold value. The processor can execute the steps of the automated winterization process when the sensed temperature value is at or below the pre-defined threshold value. The automated winterization process includes turning off a pump and actuating a first automatic valve of an air-moving device to a closed state to stop water flow from the pump to the swimming pool or spa through a skimmer. The automated winterization process further includes activating the air-moving device to create positive air pressure and displacing air with water using the air-moving device in a first loop path of the connected aquatic system. The automated winterization process can also include actuating a second automatic valve of the skimmer to the closed state to prevent infiltration of the water when the positive air pressure is removed.

In some aspects, the method can further include actuating a third automatic valve of a filter to an open state to drain the water from the filter. The method can also include actuating the first automatic valve of the air-moving device to an open state to displace water with air in the tubing up to the skimmer. In some forms, the method can also include displacing the water with the air using the air-moving device in a second loop path of the connected aquatic system. The process of displacing the water with the air can include actuating a third automatic valve of a filter to the closed state after the water is drained from the filter. The displacement process can further include actuating the first automatic valve of the air-moving device to an open state to allow the air to flow into the second loop path. The method can further include actuating a fifth automatic valve of the one or more pool returns to the closed state to prevent water infiltration when the positive air pressure is removed and turning off the air-moving device. In some forms, in the first loop path, the automated winterization process is executed from a skimmer to the swimming pool or spa. In some aspects, in the second loop path, the automated winterization process is executed from the pump to the swimming pool or spa. In some embodiments, in the second loop path, the pump is connected to the filter, which is connected to a heater. The heater can be connected to a sanitizer, which is connected to the one or more pool returns. The one or more pool returns can be connected to the swimming pool or spa.

In another embodiment, a connected aquatic system configured to execute an automated winterization process for a swimming pool or spa is provided. The connected aquatic system can include a control system provided in the form of a receiver, a processor, and a memory. The system can also include a temperature sensor designed to collect a sensed temperature value. The receiver is configured to receive the sensed temperature value from the temperature sensor. The processor is configured to compare the sensed temperature value to a pre-defined threshold stored in the memory. The processor is further configured to execute the automated winterization process for the swimming pool or spa. The system further includes an air-moving device designed to displace water with air when the processor executes the automated winterization process.

In some aspects, the control system further includes a transmitter configured to generate and transmit an initiation message to a mobile device of a user associated with the swimming pool or spa. In some forms, the initiation message includes a recommendation for executing the automated winterization process based on the sensed temperature value compared to the pre-defined threshold stored in the memory. In some aspects, the system further includes one or more moisture detection sensors located in a first loop path and a second loop path of the connected aquatic system. In some embodiments, the system further includes one or more automatic valves designed to be actuated by the control system to direct displacement of the water in a first loop path or a second loop path of the connected system. In some forms, the air-moving device is provided in a form of an air blower, an accumulator, or an air compressor.

DETAILED DESCRIPTION

Figure 1:
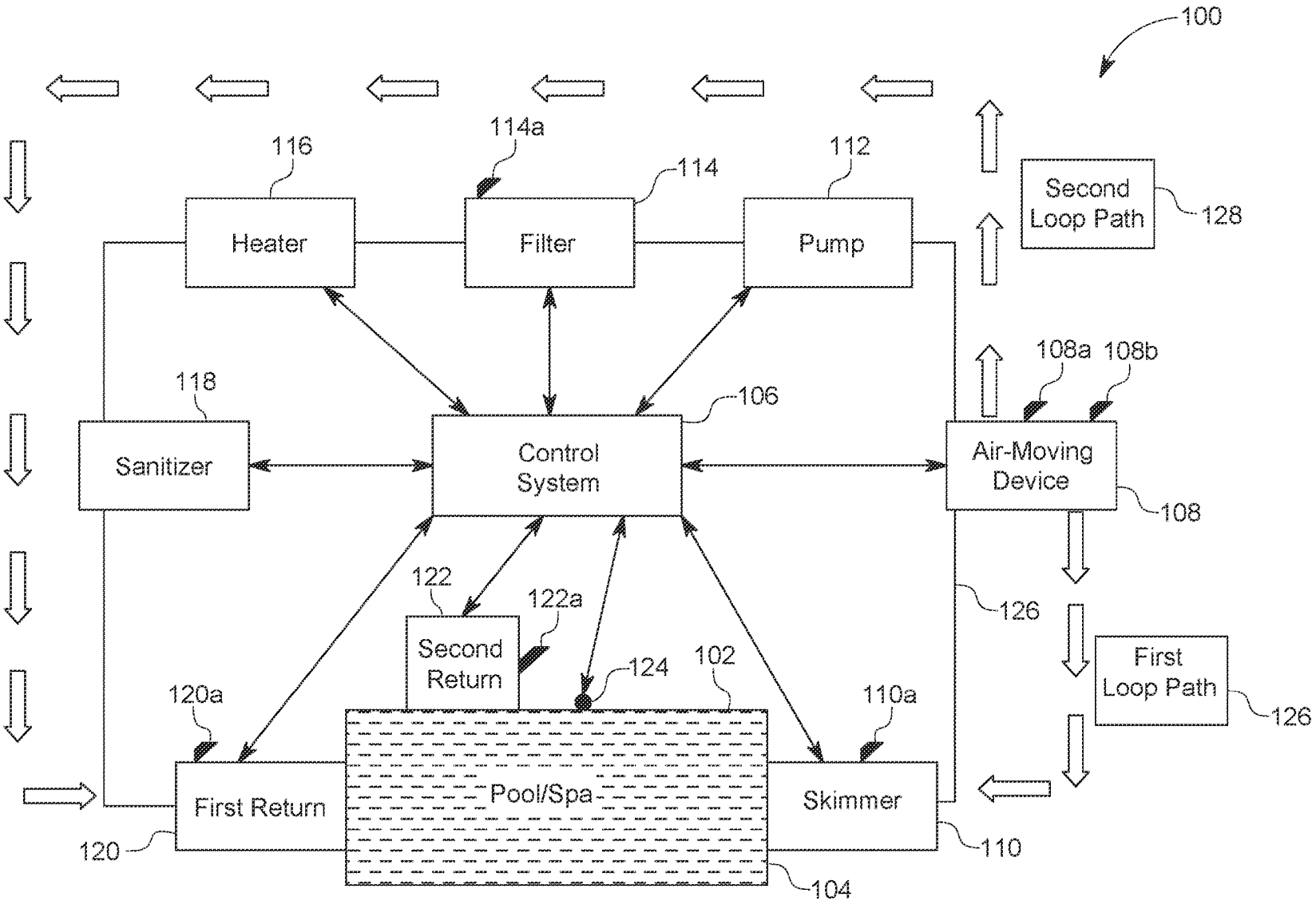
FIG. 1 is a system diagram of a connected aquatic system, according to a disclosed embodiment.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. It will be understood that "connected" and "coupled" are not restricted to physical or mechanical connections or couplings.

The following discussion is presented to enable a person skilled in the art to make and use embodiments of the disclosure. Various modifications to the illustrated embodiments will be readily apparent to those skilled in the art, and the generic principles herein can be applied to other embodiments and applications without departing from embodiments of the disclosure. Thus, embodiments of the disclosure are not intended to be limited to embodiments shown but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the disclosure. Skilled artisans will recognize the examples provided herein have many useful alternatives and fall within the scope of embodiments of the disclosure.

FIG. 1 illustrates an exemplary connected aquatic system 100 (hereinafter "connected system"), according to disclosed embodiments. When used throughout the disclosure, it will be understood by one skilled in the art that an "aquatic system" can include, for example, any residential aquatic system, like a pool or spa system, or similar. The connected system 100 can be provided in the form of a swimming pool or spa 102 having water 104, a control system 106, and one or more system components. The system components are provided in communication with each other and with the swimming pool or spa 102 to form a fluid circuit. The fluid circuit facilitates water movement through the swimming pool or spa 102 and the system components to accomplish various tasks including, but not limited to, pumping, cleaning, heating, sanitizing, lighting, and any other similar tasks. In some embodiments, the fluid circuit can include piping or any other similar structures to direct water flow through the connected system 100. In some embodiments, at least some portions of the system components (e.g., electrical components, such as wires, internal circuitry, etc.) may be waterproofed, covered, coated, arranged, or otherwise protected from water damage. Additional arrangements of the connected system 100 besides the example shown in FIG. 1 are also contemplated.

The system components can be provided in the form of an air-moving device 108, a skimmer 110, a pump 112, a filter 114, a heater 116, a sanitizer 118, a first pool return 120, a second pool return 122, and one or more sensing devices 124. The control system 106 is connected to the each of the one or more system components. In some forms, the first pool return 120 and the second pool return 122 are provided in the form of automatic pool returns.

In some embodiments, the air-moving device 108 is provided in the form of an air blower, an air compressor, or an accumulator. In some aspects, the air-moving device 108 includes a tank configured to hold an amount of air and a bladder for maintaining an air pressure. It will be understood that the air-moving device 108 can be provided in the form of another type of device capable of moving air while maintaining a set air pressure level. The air-moving device 108 may be coupled to, integrated with, or otherwise connected to the one or more system components of the connected system 100 to eliminate manual efforts for connecting and disconnecting the air-moving device 108 to perform winterization of the swimming pool or spa 102. In some forms, the air-moving device 108 is installed in a location between the pump 112 and the skimmer 110.

In some embodiments, the control system 106 is connected to the one or more system components using a wired communication connection, a wireless communication connection, or a network communication connection. Non-limiting examples of the communication connection include Bluetooth, cellular, satellite, GPS, RS-485, RF, MODBUS, CAN, CANBUS, DeviceNet, ControlNet, Ethernet TCP/IP, RS-232, Universal Serial Bus ("USB"), Firewire, Thread, proprietary protocol(s), other known communication protocol(s), the Internet, intranets, extranets, wide area networks ("WANs"), local area networks ("LANs"), wired networks, wireless networks, cloud networks, or other suitable networks, or any combination of two or more such networks or protocols.

In some aspects, the sensor 124 is provided in the form of a temperature sensor. The sensor 124 is configured to sense the ambient temperature of a geographic location where the swimming pool or spa 102 is located. The sensor 124 is further configured to transmit a value of the sensed ambient temperature to the control system 106, as described in more detail in connection with FIG. 3.

In some aspects, the sensor 124 is positioned proximate to the swimming pool or spa 102. In some examples, the sensor 124 is positioned in the water 104. In some alternative embodiments, the sensor 124 is positioned at or near the control system 106. In some embodiments, the sensor 124 transmits a value of the sensed temperature to the control system 106 in a pre-defined time interval (e.g., every 30 minutes). In some embodiments, the sensor 124 transmits a value of the sensed temperature to the control system 106 based on an event trigger (e.g., the start of the day, a specific time, a specific temperature, etc.). The pre-defined time interval and/or triggering event(s) can be defined by an owner of the swimming pool or spa 102 or a technician servicing the swimming pool or spa 102. In some embodiments, the owner, technician, or other user can configure the predefined time interval, triggering event(s), or other settings of the connected system 100 using a mobile application or other computing device. The computing device can be any device capable of connecting to the Internet (e.g., a smartphone or tablet, a computer, or another display interface).

The control system 106 receives the sensed temperature value from the sensor 124 and compares the sensed temperature value with a pre-defined threshold value. In some embodiments, the pre-defined threshold value is set or defined by the owner of the swimming pool or spa 102 or the technician of the swimming pool or spa 102. In a non-limiting embodiment, the pre-defined threshold value ranges from 35° F. and below. The pre-defined threshold value can be defined by the owner or the technician of the swimming pool or spa 102 using the mobile application or other computing device. Although the present disclosure references a particular temperature value (i.e., 35° F.) for the top value of the pre-defined threshold value, it will be understood by a person skilled in the art that other temperature values can be used as the pre-defined threshold value.

If the sensed temperature value is above the pre-defined threshold value, the control system 106 does not initiate the winterization process. However, if the sensed temperature value is the same as or below the pre-defined threshold value, the control system 106 initiates an automated winterization process for the swimming pool or spa 102. The control system 106 iteratively compares the sensed temperature value from the sensor 124 with the pre-defined threshold value to automatically determine the appropriate time to initiate the winterization process for the swimming pool or spa 102. In some non-limiting examples, the control system 106 can be configured to initiate the winterization process after the pre-defined threshold temperature value has been reached or exceeded for multiple days in a row.

In some embodiments, the control system 106 can utilize an advanced learning model to analyze data and generate trends to determine the appropriate time to initiate the winterization process. In some forms, the control system 106 can be communicatively coupled to an interface provided in the form of a weather API. The weather API can use one or more advanced learning models to predict cost savings based on earlier winterization data compared to a later winterization date. For example, the advanced learning model can be trained on weather data, historical data, user data, and other types of data to evaluate weather patterns for a relevant geographic area (e.g., where the swimming pool or spa is located). In some forms, demand for heat, heating costs, and environmental conditions can be parameters analyzed by the advanced learning model. In some aspects, the advanced learning model can generate recommendations to improve system efficiency during operating months of the swimming pool or spa 102, including but not limited to a hybrid heating mode and a heating schedule based on weather patterns. In some aspects, the advanced learning model can be provided in the form of a machine learning model or other advanced artificial intelligence-based process.

In some embodiments, before initiating the automated winterization process, the control system 106 transmits an initiation message to the mobile device or other computing device of the user associated with the swimming pool or the spa 102 for performing the automated winterization process. The initiation message can be provided in the form of a notification to inform the user associated with the swimming pool or spa 102 that an automated winterization process will be performed since the sensed ambient temperature has reached (or is below) the pre-defined threshold value, according to the configuration settings of the connected system 100. The user of the swimming pool or spa 102 can either accept or deny to perform the automated winterization process. If accepted by the user the mobile device or other computing device can generate and transmit a confirmation message to the control system 106 to initiate the automated winterization process. If denied or rejected, the mobile device or other computing device can generate and transmit a rejection message to the control system 106. If the control system 106 receives the confirmation message, the control system 106 can execute the steps for performing the automated winterization process. If the control system 106 receives the rejection message, the control system can maintain the current state and not execute the steps for performing the automated winterization process.

In some embodiments, the control system 106 does not wait to receive the confirmation message before executing the steps for performing the automated winterization process. In some aspects, the control system 106 automatically starts performing the automated winterization process once the sensed temperature value reaches or drops below the pre-defined threshold value temperature. It will be understood that this example is non-limiting and the pre-defined threshold value and/or trigger for initiating the automated winterization process can vary based on the configuration settings of the connected system 100.

The control system 106 executes the steps to perform the automated winterization process based on the sensed temperature value. The automated winterization process can include displacing the water 104 with air using the air-moving device 108 in a first loop path 126 and a second loop path 128. In some aspects, in the first loop path 126, the skimmer 110 is directly connected to the swimming pool or spa 102. In the second loop path 128, the pump 112 is connected to the filter 114, which is connected to the heater 116. In the example shown in FIG. 1, the heater 116 is further connected to the sanitizer 118. The sanitizer 118 is connected to the first pool return 120 and the second pool return 122, which are also connected to the swimming pool or spa 102.

In some aspects, the air-moving device 108 includes an automatic first valve 108*a* and an automatic second valve 108*b*. In some forms, the filter 114 includes an automatic valve 114*a*. In some embodiments, the first pool return 120 includes an automatic valve 120*a* and the second pool return 122 includes an automatic valve 120*b*. In some embodiments, the skimmer 110 comprises an automatic valve 110*a*. In some aspects, the term "automatic valve" refers to a solenoid valve or a motorized ball valve. In at least this way, the connected system 100 can include one or more aspects designed to automatically seal portions of the connected system 100 to execute the automatic winterization process. For example, the connected system 100 can include automatic valves to seal the skimmer 110, the first return 120, and the second return 122 automatically.

In the first loop path 126, the automated winterization process is executed from the skimmer 110 to the swimming pool or spa 102 (e.g., in a clockwise direction, referring to FIG. 1). In the first loop path 126, the control system 106 turns-off the pump 112 and actuates the automatic valve 114*a* of the filter 114 to an open state to drain the water 104 from the filter 114. The control system 106 actuates the automatic first valve 108*a* of the air-moving device 108 to a closed state to stop water flow between the pump 112 and the swimming pool or spa 102 through the skimmer 110. Then, the control system 106 activates the air-moving device 108 to create positive air pressure and actuates the automatic second valve 108*b* of the air-moving device 108 to an open state to displace the water with air up to the skimmer 110. The automated winterization process will completely, or substantially completely, drain out the water 104 in the first loop path 126 (e.g., from the skimmer 110 to the swimming pool or spa 102, as shown in FIG. 1). The control system 106 actuates the automatic valve 110*a* of the skimmer 110 to a closed state to prevent any kind of water infiltration into or from the swimming pool or spa 102 when the air pressure is removed.

In the second loop path 128, the automated winterization process is executed from the pump 112 to the swimming pool or spa 102 (e.g., in a counter-clockwise direction in the example shown in FIG. 1). In the second loop path 128, the control system 106 actuates the automatic valve 114*a* of the filter 114 to a closed state after the water 104 is drained from the filter 114. Then, the control system 106 actuates the automatic first valve 108*a* of the air-moving device 108 to an open state to allow the air to flow into the second loop path 128 (e.g., from the pump 112 back to the swimming pool or spa 102, in the example shown in FIG. 1). This will completely, or substantially completely, drain out the water in the second loop path 128. After this, the control system 106 actuates the automatic valve 120*a* of the first pool return 120 and the automatic valve 120*b* of the second pool return 122 to the closed state to prevent water infiltration when the air pressure is removed. Lastly, the control system 106 turns off or otherwise deactivates the air-moving device 108. By circulating or blowing the air through the air-moving device 108 in the first loop path 126 and the second loop path 128, the water 104 in the fluid circuit of the connected system 100 is displaced with air and thus, is completely, or substantially completely, drained or cleared from the skimmer 110 to the swimming pool or spa 102 and from the pump 112 to the swimming pool or spa 102, respectively. In some embodiments, the term "open state" of the automatic valve refers to a state that allows water to flow. In some embodiments, the term "close state" of the automatic valve refers to a state that prevents the flow of water.

In some embodiments, the air-moving device 108 blows the air in the first loop path 126 and the second loop path 128 with a pressure of 50 pounds per square inch (psi) or less. It will be understood that this is a non-limiting example. In some aspects, the connected system 100 can further include one or more smart air devices in communication with the air-moving device 108, wherein the smart air devices can determine if water 104 or air is being displaced out of the first loop path 126 or the second loop path 128 based on a current level detected from one or more sensors. In some forms, the connected system 100 can further include one or more sound sensors designed to detect whether water or air is being displaced out of the first loop path 126 or the second loop path 128 based on detected sounds, vibrations, or similar signals detected from the one or more sound sensors.

In some embodiments, the time taken to blow the air and the amount of air blown by the air-moving device 108 in the first loop path 126 and the second loop path 128 depends on various factors. The various factors can include but are not limited to, a total length of the first loop path 126 and the second loop path 128, a load of the air-moving device 108, a current and a voltage at which the air-moving device 108 is operating, an amount of water 104 present in the first loop path 126 and the second loop path 128, a size of the swimming pool or spa 102, a size of a diameter of the plumbing of the fluid circuit of the connected system 100, an amount of plumbing in the swimming pool or spa system 100, or a combination thereof.

In some aspects, the connected system 100 further includes a process for automatically stopping the air-moving device 108 from blowing the air in the first loop path 126 and the second loop path 128 when the water is completely drained, or substantially completely drained from the first loop path 126 and the second loop path 128. In some embodiments, one or more sensors are integrated with or otherwise operatively coupled to the connected system 100 to determine if the water 104 is still present in the first loop path 126 and/or the second loop path 128. In this non-limiting example, the one or more sensors transmits a signal to the control system 106 to stop or continue operating the air-moving device 108 based on the detection of water (or lack thereof) in the first loop path 126 and the second loop path 128.

For example, if the one or more sensors sense a presence of water in any of the first loop path 126 and/or the second loop path 128, then, the sensors are configured to generate and transmit a signal to the control system 106 indicating the presence of water in the two loop paths 126, 128. In turn, the air-moving device 108 continues to blow the air in the two loop paths 126, and 128. If the one or more sensors do not sense the presence of water in the first loop path 126 and/or the second loop path 128, then, the one or more sensors can generate and transmit a signal to the control system 106 indicating an absence of water in one or both of the two loop paths 126, 128. In turn, the control system 106 generates and transmits a stop signal to the air-moving device 108. The air-moving device 108 stops blowing the air in one or more of the two loop paths 126, and 128 upon receiving and processing the stop signal.

In some embodiments, the one or more sensors comprise a first sensor located in the first loop path and a second sensor located in the second loop path. Although, the present disclosure discloses the first sensor located in the first loop path and the second sensor located in the second loop path, it will be appreciated that a single sensor can be used for the entire swimming pool or spa system 100. In some forms, the system may utilize multiple sensors for each of the first loop path and the second loop path.

In some embodiments, the one or more sensors are provided in the form of water level sensors. In some forms, the one or more sensors are provided in the form of moisture detection sensors. In some aspects, the moisture detection sensors can be used to detect leaks in the connected system 100 or other water intrusions into aspects of the fluid circuit of the connected system 100. In some forms, the connected system 100 can further include an automated robotic system for executing the automated winterization process, detecting leaks or defects in the connected system 100, or performing other tasks associated with the operation and decommissioning of the connected system 100. In some examples, the automated robotic system can include a camera, wheels, or similar movable track, a controller, and one or more subassemblies for operating the automated robotic system.

Figure 2:
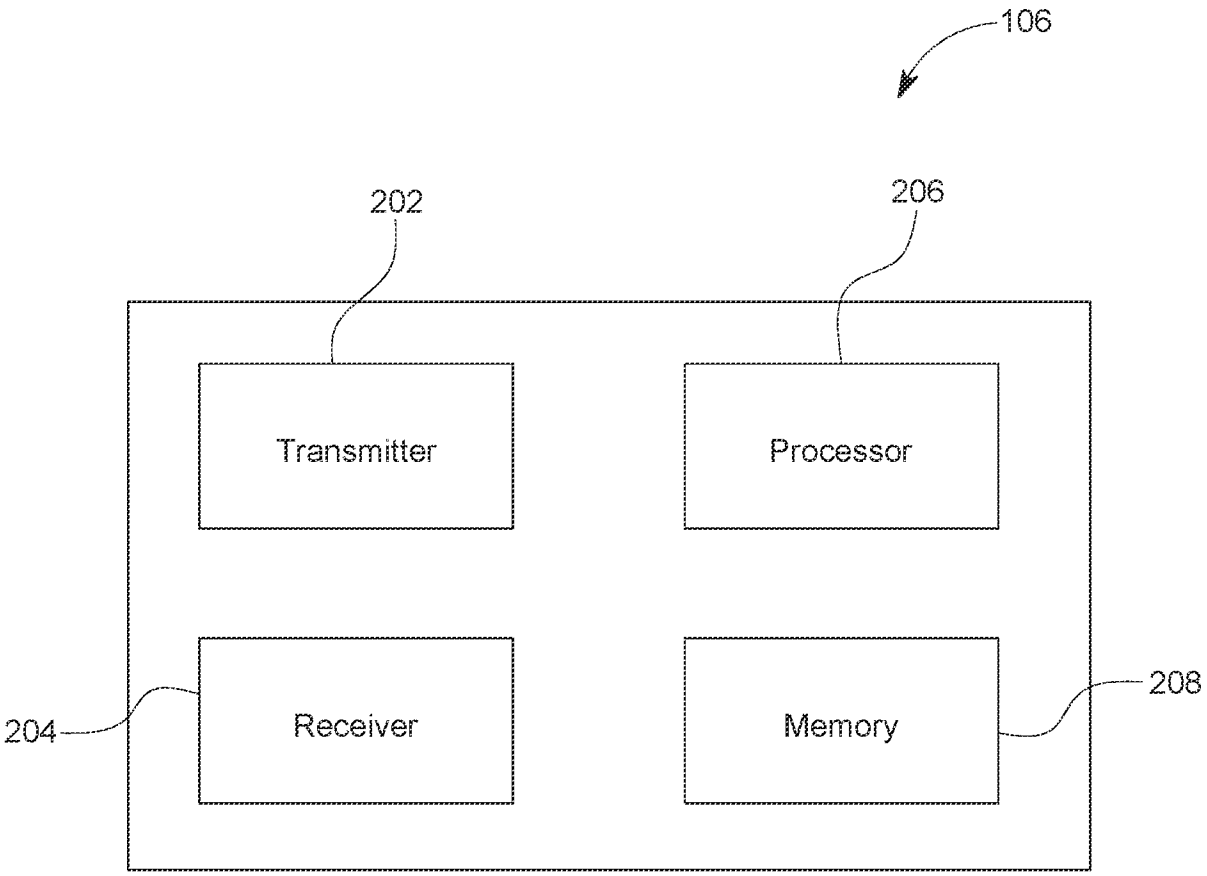
FIG. 2 is a block diagram of a winterization control system of the connected aquatic system of FIG. 1, according to a disclosed embodiment.

Referring to FIG. 2, a block diagram of the control system 106 is shown, according to an embodiment. The control system 106 includes a transmitter 202, a receiver 204, a processor 206, and a memory 208. Additional arrangements of the control system 106 besides the example shown in FIG. 2 are also contemplated.

The receiver 204 is configured to receive ambient temperature value sensed by the sensor 124. The receiver 204 is also configured to communicate the sensed temperature value to the processor 206. The receiver 204 is further configured to collect information from one or more water level sensors or water detection sensors. The receiver 204 is also configured to receive and process a confirmation message or a denial message for performing or not performing the automated winterization process. The confirmation message and/or the denial message can be generated and transmitted from the mobile device or other computing device of the user associated with the swimming pool or spa 102.

The processor 206 is configured to compare the sensed temperature value to the pre-defined threshold value. Based on the comparison, the processor determines whether to perform the automated winterization process for the swimming pool or spa 102 or not. As described in more detail in connection with FIG. 1, when the sensed temperature value goes below the pre-defined threshold value, the processor 206 executes the automated winterization process for the swimming pool or spa 102. However, when the sensed temperature value is above the pre-defined threshold value, the processor 206 does not execute the automated winterization process. The processor 206 is configured to activate the automatic winterization process for the first loop path 126 and the second loop path 128.

The transmitter 202 is configured to generate and transmit an initiation message to the mobile device or other computing device of the user associated with the swimming pool or spa 102. The initiation message can include a notification that the configuration settings associated with the automated winterization process have been met and the connected system 100 recommends initiating the automated winterization process. The transmitter 202 is further configured to activate a backwash process. The backwash process can include reversing a flow of the water 104 to flush contaminates from the filter 114 of the swimming pool or spa 102.

The memory 208 is configured to store the sensed temperature value over a period of time along with a date and a timestamp. Historical data including the sensed temperature value over the period of time can be analyzed by the processor 206 of the control system 106 to predict an appropriate time for performing the automated winterization process. For example, in the last five years, every time in the middle of October, the sensed temperature value has been detected below the pre-defined threshold value. In this non-limiting example, the processor 206 can recommend the automated winterization process for the swimming pool or spa 102 be performed in the middle of October. In some aspects, the memory 208 can store the historical data associated with the start date for the winterization process for previous years. In some forms, the advanced learning model is iteratively trained using the historical data and is used to provide intelligent recommendations to optimize system performance, minimize downtimes, and reduce operating costs.

Figure 3:
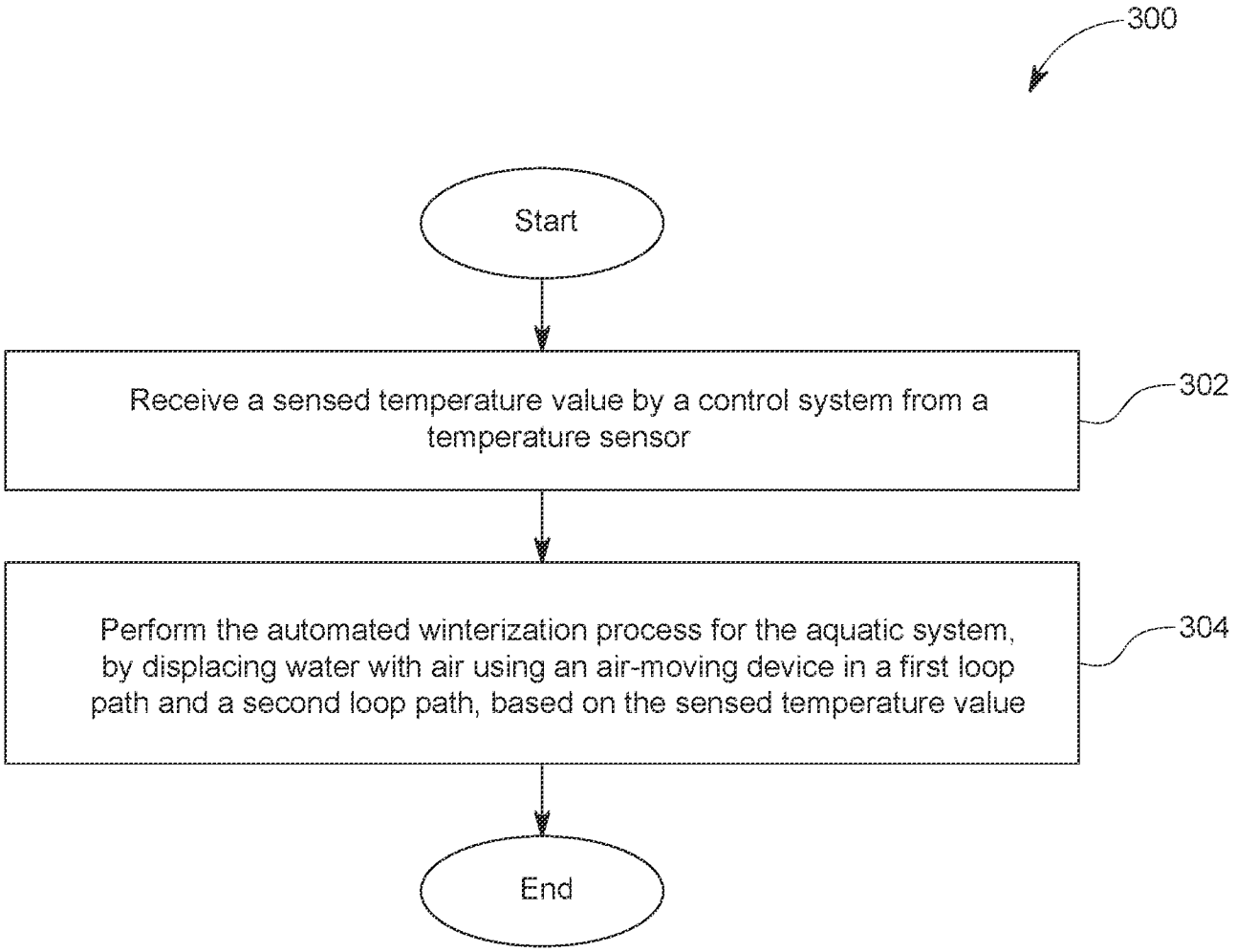
FIG. 3 is a method flow diagram for performing an automated winterization process for the connected aquatic system of FIG. 1, according to a disclosed embodiment.

Referring to FIG. 3, a method flow diagram 300 for executing an automated winterization process for a swimming pool or spa 102 is provided.

At step 302, the control system 106 receives the sensed temperature value from the temperature sensor 124. The sensor 124 senses the ambient temperature of the geographic location proximate to the swimming pool or spa 102 and transmits the value of the sensed ambient temperature to the control system 106.

At step 304, the control system 106 receives the sensed temperature value from the sensor 124 and compares the sensed temperature value with a pre-defined threshold value. If the sensed temperature value is above the pre-defined threshold value, the control system 106 does not execute any steps related to the automated winterization process. However, if the sensed temperature value is at or below the pre-defined threshold value, the control system 106 initiates the automated winterization process for the swimming pool or spa 102. The control system 106 executes the automated winterization process, by displacing the water 104 of the swimming pool or spa 102 with air using an air-moving device 108 in a first loop path 126 and a second loop path 128, as described in more detail in connection with FIG. 1. In some embodiments, the automatic winterization process further includes injecting non-toxic antifreeze into the fluid circuit of the connected aquatic system. In some aspects, the non-toxic antifreeze can be injected using a peristaltic pump. It will be understood that this example is non-limiting.

The present disclosure offers multiple technical advantages over existing solutions including providing an automated process for winterizing a swimming pool or spa. The system and method described herein also eliminate the involvement of a technician or a pool owner to decommission the swimming pool or spa to prepare for cold winter months when the swimming pool or spa is not operable. The system and method efficiently and completely (or substantially completely) clears or drains out the water in a first loop path and a second loop path through the use of an air-moving device and by actuating one or more automatic valves. The system and method provided save time and eliminate manual efforts by offering an effective and automated solution to winterize a connected aquatic system. The system and method also automatically determine an appropriate time to initiate the winterization process for the swimming pool or spa using advanced data analytics and other data processing techniques.

The previous description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

What is claimed is:

1. A method for performing an automated winterization process for a swimming pool or spa, the method comprising the steps of:

collecting a sensed temperature value using a temperature sensor;

transmitting the sensed temperature value to a control system of a connected aquatic system;

comparing the sensed temperature value to a pre-defined threshold value using a processor of the control system;

executing the steps of the automated winterization process when the sensed temperature value is at or below the pre-defined threshold value;

actuating a valve of an air-moving device to stop water flow in one or more of a first loop path and a second loop path of the connected aquatic system; and displacing water with air using the air-moving device in the first loop path and the second loop path.

2. The method of claim 1, wherein the air-moving device is positioned between a pump and a skimmer of the connected aquatic system.

3. The method of claim 1, wherein the air-moving device is provided in a form of an air blower, an accumulator, or an air compressor.

4. The method of claim 1, wherein the control system executes the automated winterization process for the swimming pool or spa when an advanced learning model generates a recommendation based on weather patterns.

5. The method of claim 1, wherein the control system predicts a time for executing the automated winterization process using an advanced learning model trained on historical data of temperature values.

6. The method of claim 1, further comprising:

generating and transmitting an initiation message to a mobile device of a user associated with the swimming pool or spa, wherein the initiation message includes a recommendation for executing the automated winterization process; and executing the automated winterization process after a confirmation message is received from the mobile device of the user associated with the swimming pool or spa.

7. The method of claim 1, wherein:

in the first loop path, the automated winterization process is executed from a skimmer to the swimming pool or spa, and in the second loop path, the automated winterization process is executed from a pump to the swimming pool or spa.

8. The method of claim 7, wherein in the first loop path, the skimmer is directly connected to the swimming pool or spa.

9. The method of claim 7, wherein in the second loop path, the pump is connected to a filter, the filter is connected to a heater, the heater is connected to a sanitizer, the sanitizer is connected to one or more pool returns, and the one or more pool returns are connected to the swimming pool or spa.

10. A method for performing an automated winterization process for a connected aquatic system including a swimming pool or spa, the method comprising the steps of:

collecting a sensed temperature value using a temperature sensor;

comparing the sensed temperature value to a pre-defined threshold value using a processor of a control system; and executing the steps of the automated winterization process when the sensed temperature value is at or below the pre-defined threshold value, wherein the automated winterization process includes the steps of:

turning off a pump;

actuating a first automatic valve of an air-moving device to a closed state to stop water flow between the pump and the swimming pool or spa through a skimmer;

activating the air-moving device to create a positive air pressure;

displacing water with air using the air-moving device in a first loop path of the connected aquatic system; and actuating a second automatic valve of the skimmer to the closed state to prevent infiltration of the water when the positive air pressure is removed.

11. The method of claim 10, further comprising:

actuating a third automatic valve of a filter to an open state to drain the water from the filter; and actuating the first automatic valve of the air-moving device to an open state to displace water with air in tubing up to the skimmer.

12. The method of claim 10, further comprising displacing the water with the air using the air-moving device in a second loop path of the connected aquatic system by executing the steps of:

actuating a third automatic valve of a filter to the closed state after the water is drained from the filter;

actuating the first automatic valve of the air-moving device to an open state to allow the air to flow into the second loop path;

actuating a fourth automatic valve of one or more pool returns to the closed state to prevent water infiltration when the positive air pressure is removed; and turning off the air-moving device.

13. The method of claim 12, wherein:

in the first loop path, the automated winterization process is executed from a skimmer to the swimming pool or spa, and in the second loop path, the automated winterization process is executed from the pump to the swimming pool or spa.

14. The method of claim 13, wherein in the second loop path, the pump is connected to the filter, the filter is connected to a heater, the heater is connected to a sanitizer, the sanitizer is connected to the one or more pool returns, and the one or more pool returns are connected to the swimming pool or spa.

15. A method for winterizing an aquatic system, comprising:

sensing a temperature with a temperature sensor;

comparing the temperature to a threshold value; and if the sensed temperature is at or below the threshold value, performing a winterization procedure including turning off a pump, closing a first valve of an air-moving device to block water flow between a skimmer and the pump, activating the air-moving device to displace water with air through a loop path, and closing a second valve of the skimmer to block water flow through the skimmer.

16. The method of claim 15, wherein the air-moving device is positioned between the pump and the skimmer.

17. The method of claim 15, wherein a control system executes the winterization procedure based on current weather patterns.

18. The method of claim 15, wherein a control system predicts a time for executing the winterization procedure based on historical temperature value data.

19. The method of claim 15, further comprising:

transmitting an initiation message to a mobile device, the initiation message recommending execution of the winterization procedure; and executing the winterization procedure upon receipt of a confirmation message from the mobile device.

20. The method of claim 15, wherein the loop path is a first loop path and further comprising draining water from a filter;

closing a third valve of the filter;

opening the first valve of the air-moving device to allow air flow into a second loop path; and closing a fourth valve of a pool return to prevent water backflow into the second loop path.

* * * * *